United States Patent [19]

Hoffman

[11] Patent Number: 4,901,883

[45] Date of Patent: Feb. 20, 1990

[54] FILE BOX WITH FRONT DOOR

[75] Inventor: Ronald J. Hoffman, Collierville, Tenn.

[73] Assignee: The Hoffman Group Division of The Ron Hoffman Group, Collierville, Tenn.

[21] Appl. No.: 327,799

[22] Filed: Mar. 23, 1989

[51] Int. Cl.[4] ..... B65D 51/00

[52] U.S. Cl. ..... 220/337; 206/425; 220/334

[58] Field of Search ..... 206/232, 309, 425; 220/334, 335, 337

[56] References Cited

U.S. PATENT DOCUMENTS

| | | | |
|---|---|---|---|
| 7,018 | 1/1850 | Dodd | 220/334 |
| 139,653 | 6/1873 | Bentley . | |
| 282,742 | 8/1883 | May . | |
| 291,574 | 1/1884 | Byrn . | |
| 402,324 | 4/1889 | Hertel . | |
| 2,055,170 | 9/1936 | Brainard . | |
| 2,201,547 | 5/1940 | Scheinman . | |
| 2,509,462 | 5/1950 | Vogel | 220/334 |
| 2,648,585 | 8/1953 | Straubel . | |
| 2,716,583 | 8/1955 | Straubel . | |
| 3,033,637 | 5/1962 | Van Donk et al. . | |
| 3,592,344 | 7/1971 | Schade | 220/23.4 |
| 3,754,639 | 8/1973 | Gellert | 220/334 |
| 3,787,923 | 1/1974 | Peterson . | |
| 3,999,246 | 12/1976 | Suska . | |
| 4,542,438 | 6/1985 | Einhaus . | |
| 4,759,443 | 7/1988 | Egly | 206/425 |

FOREIGN PATENT DOCUMENTS

| | | | |
|---|---|---|---|
| 1426373 | 12/1965 | France | 220/335 |

*Primary Examiner*—Jimmy G. Foster

*Attorney, Agent, or Firm*—Wood, Herron & Evans

[57] ABSTRACT

A file box having a door which is swingably mounted between side walls and biased toward a closed position by a spring engaged around a stub axle. The door has a pair of stub axles, one of which is preferably received in the coil of the biasing spring, which is in turn seated in a socket in one side wall of the box; the other stub axle is received in a slot in the opposite side wall, and is journaled for rotation by the end of the slot. Optionally, the door extends up just a lower portion of the front opening of the box, so as to permit viewing of contents of the box above the door while retaining such contents in the box.

12 Claims, 2 Drawing Sheets

FILE BOX WITH FRONT DOOR

FIELD OF THE INVENTION

This invention relates to file boxes or cases which open at one end, such as are used for storing magazines, folders, and the like.

PRIOR ART

Filing boxes with doors which are swingable about a horizontal axis are shown in Bently U.S. Pat. No. 139,653; May U.S. Pat. No. 282,742; Byrn U.S. Pat. No. 291,574; and Scheinman U.S. Pat. No. 2,201,547. A cabinet having a front door hinged to fold down about a horizontal axis, wherein a spring means is provided to hold the door closed, is shown in Straubel U.S. Pat. Nos. 2,648,585 and 2,716,583, and VanDonk U.S. Pat. No. 3,033,637. Einhaus Pat. No. 4,524,438 shows a record player with a hinged dust cover having upstanding ends to facilitate mounting the cover. Peterson U.S. Pat. No. 3,787,923 shows a hinge having a torsion bar biasing it toward a normal position. Other torsion spring closers are shown in Hertle U.S. Pat. No. 402,324 and Suska U.S. Pat. No. 3,999,246. The foregoing constructions are relatively complicated, expensive to manufacture, and/or difficult to assemble; and the doors typically close the entire front opening of the boxes so as to obscure viewing of the contents, and do not fully open.

SUMMARY OF THE INVENTION

The file box of this invention is defined by opposite side walls, a rear wall and a bottom which are joined to define a compartment which opens at the front. A door for closing the front opening is hinged between the side walls, preferably between ears projecting from the side walls, for rotation about a horizontal axis adjacent the bottom. The door preferably extends only partway up the front opening. Two stub hinge axles project oppositely outward from the door, perpendicular to its side edges. A spring, which is preferably a torsion spring, has one end engaged in the door and another end engaged in the box, and biases the door toward an upright closed position. The door is fully openable, so as to lie at or below the level of the floor. One stub axle of the door, preferably with the spring encircling it, is seated in a socket formed in one side wall, and the other axle is receivable and rotatable in the end of a slot formed opposite the socket in an opposite side wall of the box. This axle-receiving structure facilitates mounting the door between the walls of a rigid integral box.

DESCRIPTION OF THE DRAWINGS

The invention can best be further described by reference to the accompanying drawings, in which.

DETAILED DESCRIPTION

Figure 4:
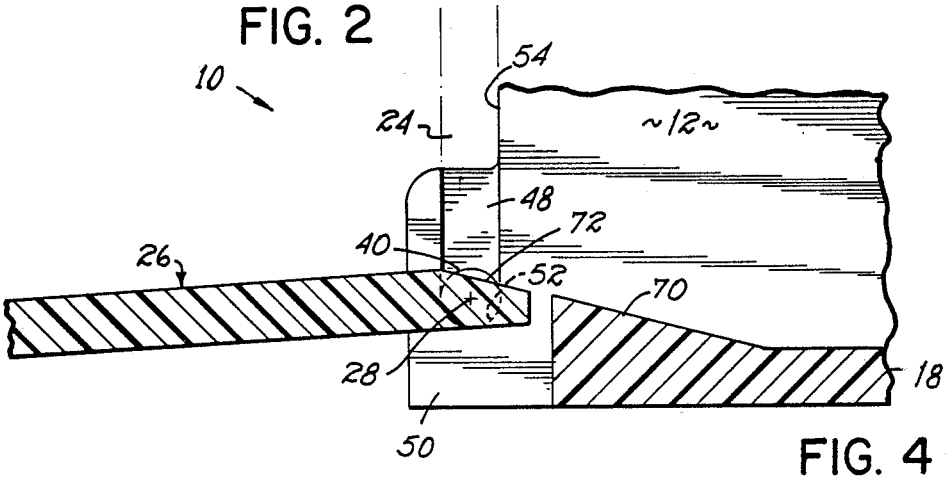
FIG. 4 is an enlarged fragmentary vertical section taken on line 4—4 of FIG. 1, but showing the door in open position.

The file box designated generally by 10 has a pair of opposite side walls 12 and 14, a rear wall 16, and a bottom 18 (FIG. 4). These elements can be formed integrally as by injection molding, or can be formed separately and joined along their edges by adhesive or by means of conventional clip tabs, not shown. For easier access to magazines 20 which are stored upright in the box, side walls 12 and 14 may be cut away as at 22, to expose upper portions of the magazines.

The file has a front opening 24 (FIG. 4), through which the magazines or other articles are insertable and removable. A door 26 closes at least the lower portion of the front opening, the door being hinged for rotation about a horizontal axis 28 which is parallel, preferably closely adjacent, to box bottom 18. (In the preferred embodiment, the door is of relatively low height, merely sufficient to close the lower part of the front opening, so as to permit the ends of the contents 20 of the box to be seen through the open end of the box.) The door 26 is generally rectangular or square, has a receptacle in slot 30 on its front into which a card (not shown) can be inserted to identify the contents or number of the file.

Door 26 has opposite side edges 34, 36, and stub axles 38, 40 (see FIGS. 2, 3 and 4) project from the door perpendicularly to these side edges. It is preferred, as best shown in FIGS. 1A and 2, that the door have a notch 42 adjacent each lower corner, inset from the respective side edge 34 or 36 (as seen in FIGS. 1A and 2) and that the stub axle 38 or 40 projects outwardly within the respective notch. Each axle is cylindrical and its diameter may lie within the thickness of the door (see FIGS. 3 and 4).

Stub axle 38 extends into a socket 44 formed in an extension or forwardly projecting ear 46 of side wall 14 (FIG. 2); axle 40 extends into the lower end 52 of a slot 48 which is formed in an ear or forward projection 50 of the opposite side wall 12 (FIG. 4). Socket 44 and the end 52 of slot 48 are aligned opposite one another so that axis of door rotation 28 is essentially parallel to the plane of bottom 18.

It will be noted that slot 48 preferably extends to top edge of ear 50 (see FIG. 4). As described in more detail below, this facilitates installation of the door 26 between the rigid ears 46, 50. Specifically, as axle 38 (together with the spring biasing means to be described) is inserted in socket 44, the door is skewed or cocked slightly so that the other stub axle 40 can be slid downwardly into the end 52 of slot 48.

Figure 1:
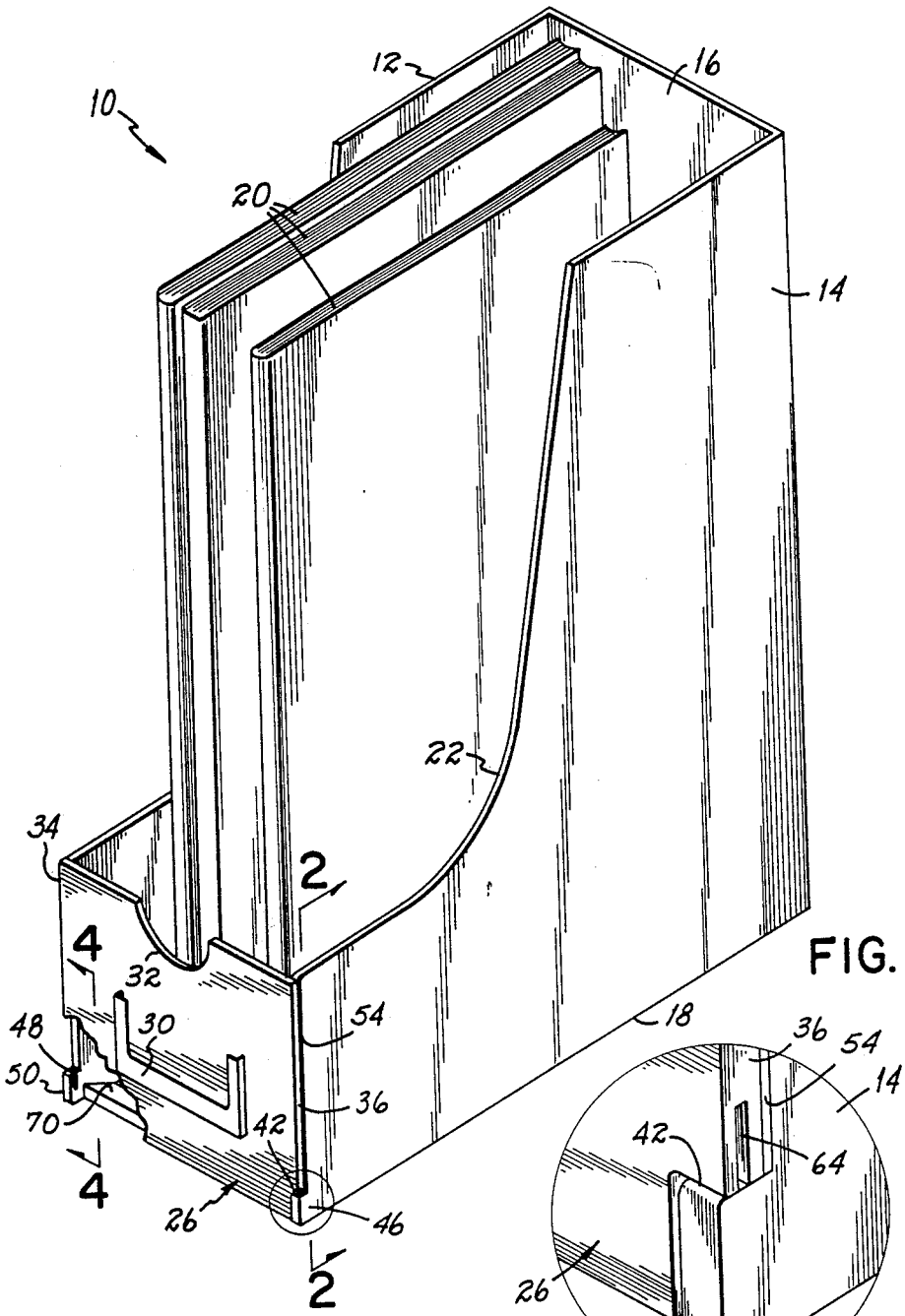
FIG. 1 is a perspective view, partly broken away, of a box in accordance with a preferred embodiment of the invention.
Figure 1A:
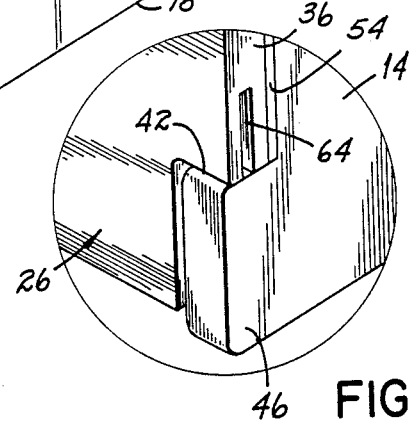
FIG. 1A is an enlarged view of the encircled portion of FIG. 1, showing the lower front corner of the box, at which the door is pivotally engaged with the side wall.
Figure 2:
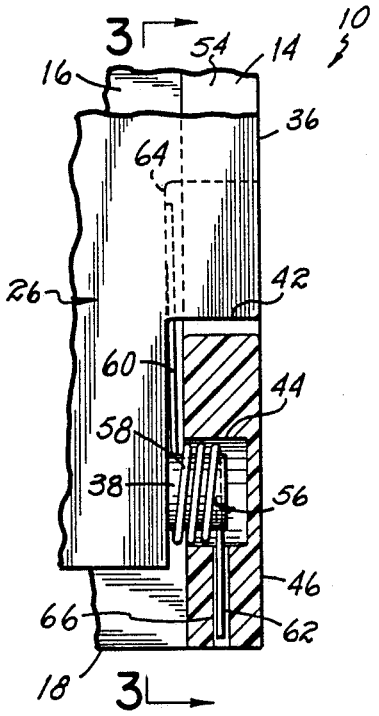
FIG. 2 is an enlarged fragmentary, vertical section taken on line 2—2 of FIG. 1.

It will be noted that socket 44 and slot 48 are so positioned on ears 46, 50 that when the door is in its upper (or closed) position (as shown in FIGS. 1, 1A and 2), the inner surface of the door is essentially vertical, and is flush against the front edges 54 of respective side walls 12 and 14. The two stub axles are preferably received entirely within the thickness of the respective side walls. By reason of the preferred overlap of the ears 46 and 50 in the door notches 42 (see FIG. 1A), neither the axles nor the ears project outwardly of the overall planes of the side walls and of the front surface of the door.

Figure 3:
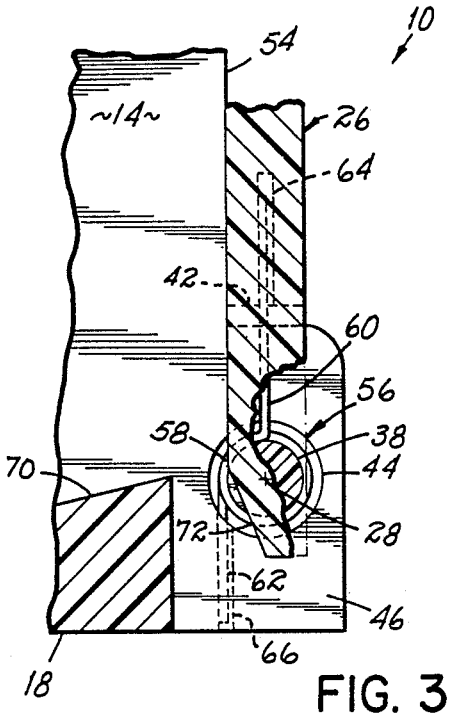
FIG. 3 is an enlarged, fragmentary vertical section taken on line 3—3 of FIG. 2.

The door is swingable from its up or closed position (shown in FIG. 1) to a down or open position (FIG. 4) in which it lies parallel to or even below the level of the bottom. This is done by pivoting the door on its axles around the pivot axis 28. It is biased toward the closed position by a spring biasing means, a preferred form of which is shown in FIGS. 2 and 3. Preferably the biasing means comprises a coil spring 56 having a coil 58 and two outwardly projecting spring ends 60 and 62.

As best seen in FIGS. 2 and 3, the coil 58 of spring 56 preferably encircles stub axle 38 and is substantially seated in socket 44. The socket supports and confines the spring coil 58; and the interior of the spring coil preferably supports and journals the axle, which is rotatable within the spring.

One end 60 of the spring is affixed to the door for rotation with it; the other end 62 is affixed to the rest of the box and remains fixed as the door is opened. Thus opening the door winds up and increases the tension on the spring. Preferably spring end 60 is received in an edgewise recess or slot 64 in the door (FIGS. 2 and 3), and may have a "crimp" or angular bend (not shown) in it, to help position it in place in slot 64. The other or opposite end 62 of the spring is received and held in a fixed hole 66 in the box bottom 18. A single spring, on one of the stub axles, is sufficient to return the door softly to closed position, although obviously dual springs could be provided if desired for more powerful closure.

In assembling the door on the box, the coil 58 of the spring is preferably inserted in socket 44 and spring end 62 is inserted in box hole 66; the stub axle 38 is then slipped inside the coil. Opposite spring end 60 is fitted in door slot 64, and the other stub axle is slid down to the end 52 of slot 48. Thus the door can be installed in a rigid box, yet the axles and the spring are effectively and unobtrusively engaged and secured.

As shown in FIG. 4, pivot axis 28 is spaced slightly upwardly from the floor of the box, to provide better support around the pivot and slot. To provide a smooth transition between the inside surface of the door and the bottom, it is desirable to provide a ramp 70 at the front edge of the bottom 18, which leads up to a bevel 72 or lip on the lower edge of the door when the door is in open position. This ramp tends to guide articles being removed from or inserted into the box, smoothly between the door and the bottom. To pull the door open, one finger can be hooked into cutout 32 in its top edge. The door swings open, preferably to a horizontal position (FIG. 4), or beyond; its swing can be limited by engagement with a part of the box.

The box that has been described herein is preferably injected molded. Alternatively, however, it can be assembled from separate pieces cut from sheet material, by adhesive or use of appropriate clips to join the various walls and to provide the sockets and axles, the clips being secured to the walls. This affords a less expensive, though less finished, appearance.

Although the invention has been described above in relation to the preferred embodiment, those skilled in the art will understand that it is not so limited and includes other embodiments within the scope and spirit of the claims which follow.

I claim:

1. A file box comprising, two spaced parallel side walls, a rear wall and a bottom, said walls and bottom joined to define a box with a front opening, a door for at least partially closing said front opening, said door hinged for rotation about an axis parallel to said bottom, said door having opposite side edges and first and second stub axles projecting from it perpendicular to said side edges, and a spring having two outwardly projecting ends, said door having a recess receiving and holding one said end of said spring, said box having a fixed hole receiving and holding the other said end of said spring, one said side wall having a socket for receiving and journaling said first stub axle, the other said side wall having a slot for receiving and journaling said second stub axle, said stub axles being engageable in said socket and slot by inserting said first stub axle into said socket and sliding the second stub axle into said slot, said spring yieldably biasing said door toward an upright closed position between said side walls.

2. The file box of claim 1 wherein said spring is a torsion spring.

3. The file box of claim 2 wherein said torsion spring has a coil and said two ends project from said coil, and said coil is disposed around said first stub axle.

4. The file box of claim 3 wherein said coil, disposed around said first stub axle, is seated within said socket.

5. The file box of claim 1 wherein said hole is formed in said bottom.

6. The file box of claim 1 wherein said recess in said door is in a side edge of said door.

7. The file box of claim 1 wherein the said ends of said spring are offset from one another, for insertion into said hole and recess.

8. The file box of claim 1 wherein said stub axles project from notches which are formed in the side edges of said door.

9. The file box of claim 1 wherein said second stub axle is journaled at an end of said slot, said end being aligned opposite said socket.

10. The file box of claim 1 wherein a ramp is provided at a front edge of said bottom, said ramp sloping upwardly to guide an article in said box onto said door when said article is being removed from said box.

11. The file box of claim 1 wherein said door is biased toward and normally against the ends of said side walls.

12. A file box locatable in a shelf space having limited vertical access, said file box comprising:

(a) two mutually spaced upright side walls, an upright rear wall adjoining said side walls, and a generally horizontally disposed bottom adjoining said side walls and rear wall to form a box having at least a front opening;

(b) a door normally positioned across a lower portion of said front opening, means pivotally mounting said door to said box for rotation about an axis lying substantially parallel to said bottom for movement between an open position no higher than said floor and an upright closed position, said door extending between said side walls and only partially closing the vertical extent of said front opening while in said closed position permitting at least partial viewing of articles within the box through an upper portion of said front opening above said door, and (c) spring means operably connected between said box and said door biasing said door toward said closed position to assist in retaining the contents of the box behind said door until said door is moved to said open position, whereby articles such as magazines may be viewably retained within the box when said door is in said closed position but can be removed by pivoting said door to said open position and withdrawing said articles while avoiding blockage by said door of access to items which may be stored on a shelf, adjacent the box.

* * * * *